United States Patent [19]

Windele

[11] 4,213,551

[45] Jul. 22, 1980

[54] RECORDING CARRIER TRANSPORT ASSEMBLY FOR USE WITH SIDE MARGIN PUNCHED RECORDING CARRIER WEBS

[75] Inventor: Josef Windele, Puchheim, Fed. Rep. of Germany

[73] Assignee: Siemens Aktiengesellschaft, Berlin & Munich, Fed. Rep. of Germany

[21] Appl. No.: 853,283

[22] Filed: Nov. 21, 1977

[30] Foreign Application Priority Data

Apr. 19, 1977 [DE] Fed. Rep. of Germany ..... 2717315

[51] Int. Cl.[2] ..... B65H 17/38

[52] U.S. Cl. ..... 226/74; 226/78; 226/79; 355/3 TR; 400/616.2

[58] Field of Search ..... 226/74, 75, 78, 76, 226/77, 79, 80, 86, 89–91; 355/3 TR, 3 SH, 3 R; 400/616.1, 616.2, 616.3; 346/136

[56] References Cited

U.S. PATENT DOCUMENTS

| | | | |
|---|---|---|---|
| 2,080,524 | 5/1937 | Allen | 226/74 X |
| 2,633,354 | 3/1953 | Mixer | 226/75 |
| 3,392,893 | 7/1968 | Bennett et al. | 226/74 |
| 3,977,780 | 8/1976 | Cassano et al. | 355/3 R X |
| 4,010,882 | 3/1977 | Turner | 226/75 X |

OTHER PUBLICATIONS

Crawford, R. P., "Automatic Feed Mechanism", *IBM Technical Disclosure Bulletin,* vol. 14, No. 4, Sep. 1971, p. 1219.

*Primary Examiner*—Bruce H. Stoner, Jr.

*Attorney, Agent, or Firm*—Hill, Van Santen, Steadman, Chiara & Simpson

[57] ABSTRACT

A recording carrier transport and feed unit is disclosed which includes attached together transport and feed assemblies for moving a side margin punched recording carrier web to, and withdrawing it from, the intermediate carrier of an electrostatic printer or copier. The transport assembly includes spaced parallel drive belts, each trained about at least three spaced wheel means, one of which is rotatably driven. One span of the belts presents the recording carrier to the feed device while another span withdraws the recording carrier from the feed device. The feed device presents the recording carrier to the intermediate carrier and directs it away from the intermediate carrier. The entire unit is pivotable towards and away from the intermediate carrier.

8 Claims, 4 Drawing Figures

RECORDING CARRIER TRANSPORT ASSEMBLY FOR USE WITH SIDE MARGIN PUNCHED RECORDING CARRIER WEBS

BACKGROUND OF THE INVENTION

1. Field of the Invention

This invention relates to nonmechanical printers and copiers and more particularly to a recording carrier transport device for use in association with side margin punched recording carrier webs to move the same past a cylindrical intermediate carrier in cooperation with the recording carrier feed assembly.

2. Prior Art

Nonmechanical high speed printers and copiers which apply characters or images to a recording carrier by a transfer method from an intermediate carrier are known to the art. Such printers and copiers frequently work by electrostatic techniques and involve the transfer of a toner image from an intermediate carrier on which the image is formed to a recording carrier on which the image is to be printed. The recording carrier may, for example, be a paper sheet or web. In such devices means are provided for moving the recording carrier to the transfer station and withdrawing it from the transfer station when a print has been made. Such devices include both means for transporting or moving the paper and feed means for presenting it to, and withdrawing it from, the surface of the intermediate carrier. The intermediate carrier is normally a drum.

An appropriate feed assembly for presenting the recording carrier to and withdrawing it from the drum surface is shown in German Patent Application P 26 36 326.8, U.S. Patent Application Ser. No. 820,216, now U.S. Pat. No. 4,131,358, the teachings of which are herein incorporated by reference. In that construction the feed assembly includes two moving gripping arms which can present the recording carrier to the intermediate carrier and can lift the recording carrier away from the intermediate carrier while simultaneously taking up any length of recording carrier released in the process.

In order for the feed assembly to function, the recording carrier transport assembly must be disposed both upstream, (in front of) and downstream, (behind) the feed assembly. The transport assembly thus functions to feed the recording carrier in a suitable manner to the feed assembly and to thereafter remove the printed recording carrier from the feed assembly. Such transport devices can, for example, comprise feed tracks which are positioned both upstream and downstream of the feed assembly.

SUMMARY OF THE INVENTION

It is a principle object of this invention to provide a recording carrier transport assembly which is particularly well matched with the recording carrier feed assembly.

This object is achieved by uniting the transport assembly and feed assembly into an attached together unit forming transport and feed unit. The complete unit can be pivoted away from the intermediate carrier. The recording carrier transport assembly utilizes two endless belt assemblies which are positioned parallel to one another on one side of the feed assembly. One of the belts contacts the punched holes of the side margin punched recording carrier on one side of the recording carrier and the other of the belts contacts the punched holes on the other side of the recording carrier. Each of the belt assemblies is provided with at least three wheel members around which the belt is trained. One of the wheel members of each belt assembly can be driven by means of a drive shaft. The transport assembly is constructed such that the recording carrier is held by the transport assembly in a manner in which it properly rests on the guides of the feed assembly.

In the preferred embodiment illustrated, the first of the wheels for the endless belt, as viewed in the direction of movement of the recording carrier, is attached to a drive shaft. The transport and feed unit is made pivotable about this drive shaft. This construction eliminates the necessity of otherwise pivoting other drive components such as, for example, the motor. It is desirable for the transport and feed unit to pivot so as to give immediate clearance access to the recording carrier in order to allow the recording carrier to be properly inserted during recording carrier change.

Further, in the preferred embodiment the direction of movement of the recording carrier through the feed unit can be modified by controlling the arrangement of the belt assemblies within the transport assembly. This makes it possible to determine the direction of travel of the recording carrier as it enters or leaves the feed assembly as desired in a simple manner since the positioning of the recording carrier at the feed assembly is dependent upon the arrangement and positioning of the belt assemblies.

Furthermore, it is preferred to drive the non-drive shaft belt assembly wheels by the endless belt thereby eliminating the need for any special drive belt or mechanism.

The punched hole engaging pins of the endless belts can be spaced from one another such that they engage only every second punched hole of the recording carrier. Then, by adjusting the span of the recording carrier around the feed assembly between the wheels from the wheel position immediately in front of the feed arrangement to the wheel positioned immediately behind the feed arrangement in the direction of movement of the recording carrier, in relation of the span of belt between those wheels, it is possible to engage alternate punched holes of the recording carrier upstream and downstream of the feed arrangement. This results in a reduction in strain applied to the feed holes by the driving pins of the belts.

Further, in the preferred embodiment illustrated, in order to provide for different width recording carriers, one of the belt assemblies can be made movable towards and away from the other belt assembly. The other belt assembly may be fixed in position. Thus the gap between the two belt assemblies can be controlled to accommodate differing recording carrier widths.

It is therefore an object of this invention to provide a recording carrier transport device utilizing parallel spaced drive belt assemblies which engage marginal side punched hole portions of the recording carrier to move the recording carrier to a feed assembly and to remove the recording carrier from the feed assembly, the belts being trained around wheels and at least one of the wheels being motor driven.

It is another object of this invention to provide a combined transport and feed unit for recording carriers in nonmechanical copiers and printers wherein a transport assembly includes parallel spaced apart endless belt assemblies with endless pin carrying belts trained around wheel members, at least one of which is motor driven, the transport assembly effective to move a recording carrier to a feed assembly for presentation to, and removal from the intermediate carrier, the transport assembly also effective to remove the recording carrier from the feed assembly, and the recording carrier and feed assembly joined together in a single unit being pivotable towards and away from the intermediate carrier.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
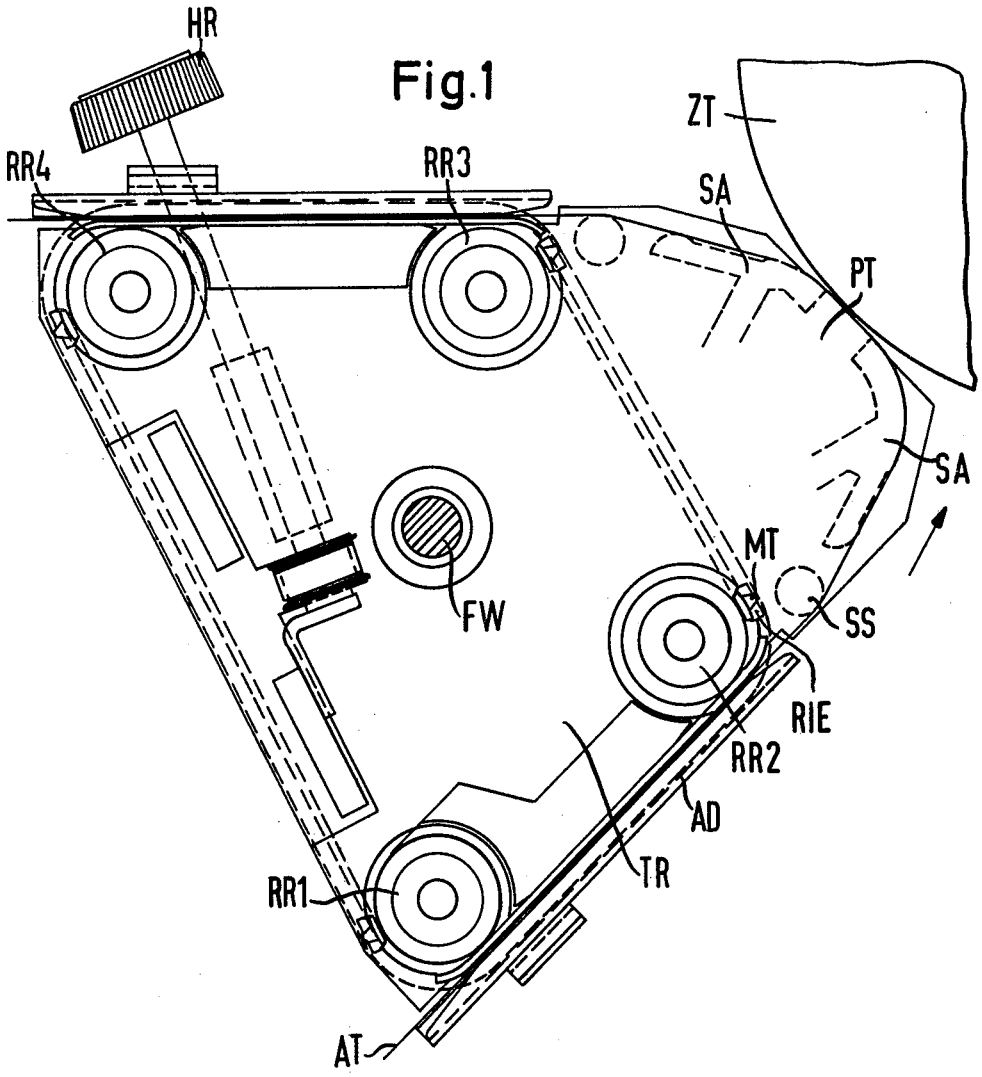
FIG. 1 is a diagrammatic side plan view of a transport and feed unit according to this invention positioned adjacent an intermediate carrier.

FIG. 1 illustrates a portion of an intermediate carrier ZT which may for example be a photoconductor drum. A recording carrier feed assembly PT is positioned adjacent the intermediate carrier ZT. The feed arrangement PT may be of the design indicated in the aforementioned German application. The feed assembly includes pivotable saddles SA over which a recording carrier AT is drawn. Supporting saddles SS may also be utilized in directing the recording carrier. The feed assembly is effective to direct the recording carrier AT to the intermediate carrier ZT to properly present it thereto, and to withdraw it therefrom.

Figure 2:
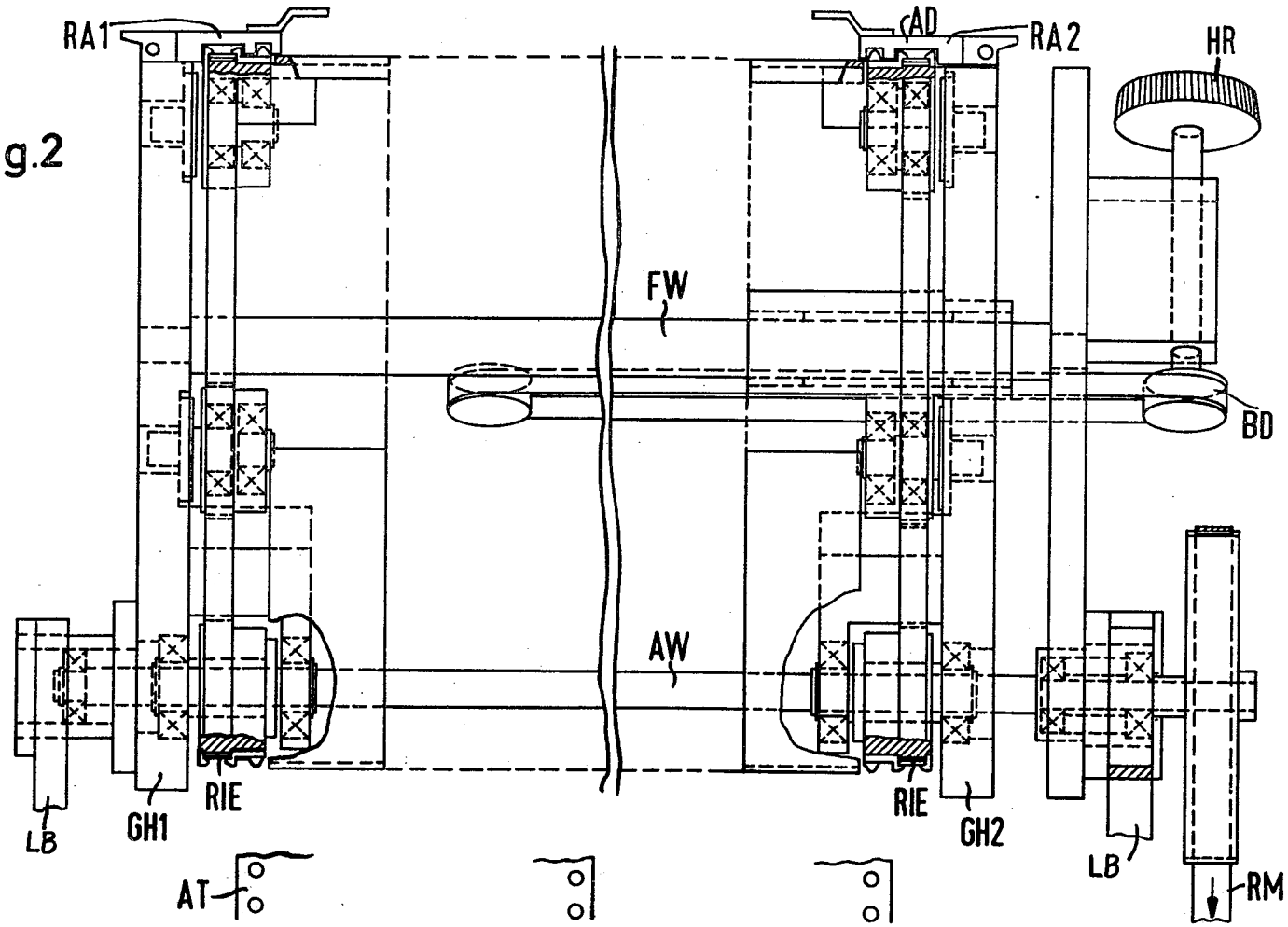
FIG. 2 is a front end view of the device of FIG. 1.

Positioned immediately adjacent the feed assembly, on a side thereof opposite the recording carrier ZT, is a transport assembly TR. The transport assembly comprises bascially two spaced apart parallel belt assemblies RA1 and RA2 with the belt assembly RA1 being illustrated in FIG. 1. The assemblies include supporting frame members. FIG. 2 illustrates, partially, both of the belt assemblies RA1 and RA2. Both assemblies include endless conveyor belts. One of the belt assemblies is provided for a row of punched feed holes on one marginal side of the recording carrier whereas the other belt assembly is provided for a row of feed holes on the other side of the recording carrier. For example the belt assembly RA1 may be provided for the punched feed holes on the left hand side of the recording carrier AT while the belt assembly RA2 indexes with the punched feed holes on the right hand side of the recording carrier.

In the embodiment illustrated in FIGS. 1 and 2 each of the belt assemblies includes 4 wheels RR1 to RR4 and one conveyor belt RIE which is trained around the wheels. In this example the belt RIE comprises a toothed belt having driving pins MT spaced along the length thereof which are engageable in the recording carrier punched holes.

Each of the wheels RR1 to RR4 are attached to a side wall GH1 or GH2 of the unit housing or supporting frame member LB. The wheels RR2 to RR4 of each of the belt assemblies are mounted on the side wall GH1 or GH2 and are not interconnected by shaft means. However wheels RR1 of each of the belt assemblies are interconnected with one another through a drive shaft AW. The shaft AW may be driven from one end thereof by drive means such as, for example, a drive belt RM which is connected to a motor (not shown). The other wheels RR2 to RR4 of each of the belt assemblies are driven through the endless belt RIE from the driven wheel RR1. Thus no independent drive belts are needed for the wheels RR2 through RR4. The wheels and belt may be cogged if desired.

The feed assembly and transport assembly are attached together into a single unit and are pivotable about the drive shaft AW. In this manner the entire unit can be swung away from the intermediate carrier ZT or pivoted back towards it. When the transport and feed unit is swung away from the intermediate carrier ZT both the transport assembly and the feed assembly will be easily accessible thereby facilitating insertion of a new recording carrier AT.

Recording carrier AT is pressed against the belts RIE by pressure plates AD which act in a known manner. The use of the pressure plates assures trouble free pick-up of the recording carrier by the driving pins MT. This also insures that the recording carrier AT will be held securely in the transport assembly and will be taut and therefore in proper contact with the guides of the feed assembly PT.

The direction in which the recording carrier is run into or out of the feed assembly can be determined largely by the arrangement of the wheels RR1 to RR4. This makes it possible to change the run out direction of the recording carrier without affecting the entry direction. For example if it is desired to reduce the output angle of movement of the recording carrier from that illustrated in FIG. 1, a different positioning of wheel RR3 or of wheels RR3 and RR4 provide the desired result. Thus the direction in which the recording carrier enters or leaves the feed assembly, and/or, if desired, the unit, can be easily adapted to suit design requirements.

One of the belt assemblies RA1 and RA2 can be in a fixed position within the copier housing. For example the belt assembly RA1 can be in a fixed position. The second belt assembly RA2 can then be made movable such that the transport assembly can be adjusted to match the width of the recording carrier being used. To accomplish this adjustability, a guide shaft FW is provided. The belt assembly RA2 is axially movable along the guide shaft FW. A hand wheel HR can be provided for adjusting a belt BD to which the belt assembly RA2 is attached to move the belt assembly RA2 towards and away from the belt assembly RA1 along the guide shaft. By this means the gap between the belt assemblies can be adjusted.

The endless belts RIE can, preferably, comprise toothed belts having driving pins MT disposed therealong in a known manner. According to this invention, it is preferred to select the spacing of the pins MT along the belt RIE such that the pins will engage only in every second punched feed hole of the recording carrier AT. By then choosing the length of recording carrier between wheels RR2 and RR3 with respect to the belt spacing, it can be assured that the pins MT on the upstream side of the feed assembly will engage alternate holes from the pins on the downstream side of the feed assembly. In order to provide for proper adjustment, the positioning of the wheels may be adjustable in the frame members. For example the length of recording carrier through the feed assembly can be modified by moving the location of wheel RR3. This enables tension of the recording carrier on the feed assembly to be adjusted. In contrast the tension of the belt RIE can be adjusted by moving wheel RR4.

Figure 3:
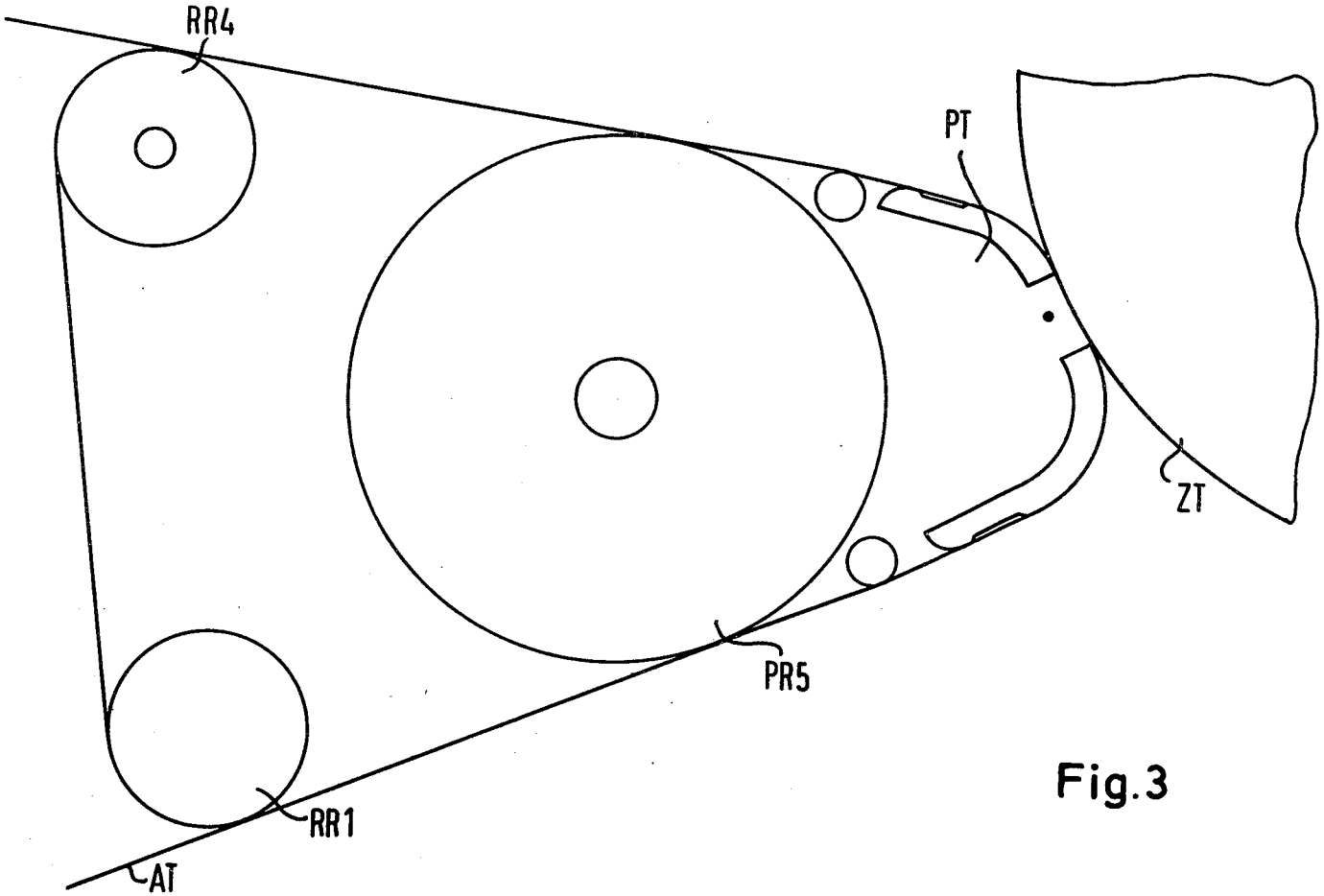
FIG. 3 is a diagrammatic side plan view illustrating a second embodiment of the transport and feed unit of this invention.

FIGS. 1 and 2 illustrate one embodiment of the transport assembly utilizing 4 wheels RR1 through RR4. FIG. 3 diagrammatically illustrates a modification of that embodiment which makes use of three such wheels. In this embodiment the wheels RR2 and RR3 of FIGS. 1 and 2 have been replaced by a single large wheel RR5. Once again the direction which the recording carrier takes entering or leaving the feed assembly can be adjusted without adversely affecting the performance of the transport assembly which can, for example, still contact the recording carrier even should the direction of movement of the recording carrier as it enters or leaves the feed assembly be other than as illustrated.

In the embodiment of FIG. 3 wheel RR1 is again driven by a shaft AW about which the entire transport and feed unit can be pivoted. The remainder of the design of the embodiment of FIG. 3 is substantially the same as illustrated in FIGS. 1 and 2.

Figure 4:
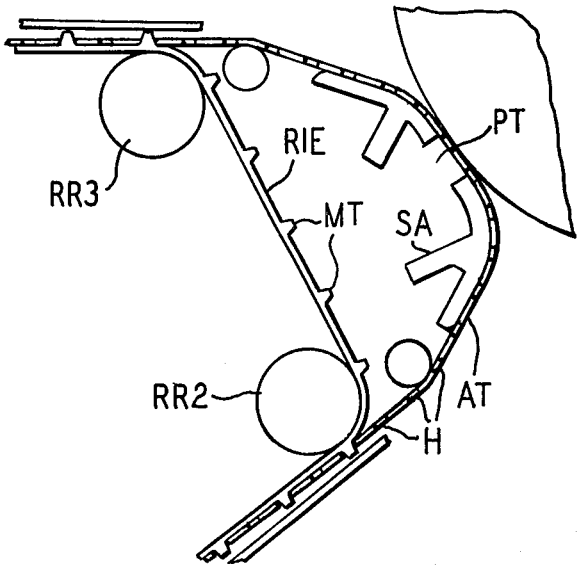
FIG. 4 is a diagrammatic fragmentary side plan view of a transport and feed unit according to this invention illustrating relative spacing of drive pins and recording carrier holes.

As illustrated in FIG. 4, whenever the spacing of the holes H of the side margin punched recording carrier AT is half the spacing of the pins MT, only every other hole will be engaged by a pin. By then controlling the spacing between the wheels RR2-RR3 with respect to the length of the recording carrier between those wheels, it can be assured that the holes which are engaged by the pins MT on one side of the feed assembly PT will not be engaged by the pins on the other side. For example, as illustrated, if the space between the wheels RR2-RR3 is such that the span of the belt RIE therebetween has an odd number of pins MT while the span of the recording carrier AT between the wheels RR2-RR3 has an even number of holes H, the desired alternating engagement of the holes by the pins on opposite sides of the feed arrangement PT will be accomplished.

Although the teachings of my invention have herein been discussed with reference to specific theories and embodiments, it is to be understood that there are by way of illustration only and that others may wish to utilize my invention in different designs or applications.

I claim as my invention:

1. A device for moving a side margin row punched recording carrier past an intermediate carrier in a nonmechanical printer device having a frame means comprising: a frame means carried combined transport and feed unit including a transport assembly having means to move said recording carrier and a feed assembly having means to present the recording carrier to and to direct it away from the intermediate carrier, means allowing the unit to pivot with respect to the frame towards and away from the intermediate carrier, the transport assembly including spaced apart first and second endless belt drive assemblies each engageable with an opposite side margin row of punched holes of the intermediate carrier, said belt assemblies effective to supply a recording carrier to the feed assembly and to withdraw it therefrom, the belt assemblies each including at least one belt trained about at least three wheel means with at least one of the wheel means being rotatably driven, at least one of the wheel means of each belt assembly lying on an infeed side of an area of presentment of the recording carrier to the intermediate carrier and at least a second of the wheel means of each of the belt assemblies lying on an outfeed side from the point of presentment, each belt assembly having at least a third wheel means lying on one of the infeed or outfeed side of the point of presentment, each of the wheel means having rotational axes, the rotational axes of one of the wheel means lying in a plane other than a plane connecting the axes of the remaining two of the three wheel means.

2. A device according to claim 1 wherein the recording carrier has a direction of movement through the unit, and the first wheel of each of the belt assemblies in the direction of movement of the recording carrier is mounted on a drive shaft, the unit being pivotable about the drive shaft.

3. A device according to claim 2 wherein the wheels other than the first wheel are rotatably driven by the belt.

4. A device for moving a side margin row punched recording carrier past an intermediate carrier in a nonmechanical printer device having a frame means comprising: a frame means carried combined transport and feed unit including a transport assembly having means to move said recording carrier and a feed assembly having means to present the recording carrier to and to direct it away from the intermediate carrier, means allowing the unit to pivot with respect to the frame towards and away from the intermediate carrier, the transport assembly including spaced apart first and second endless belt drive assemblies each engageable with an opposite side margin row of punched holes of the intermediate carrier, said belt assemblies effective to supply a recording carrier to the feed assembly and to withdraw it therefrom, the belt assemblies each including at least one belt trained about at least three wheel means with at least one of the wheel means being rotatably driven, wherein the belt includes spaced drive pins for engaging in punched holes of the recording carrier, the drive pins being spaced from one another such that they engage only every second hole of the recording carrier, at least some of said wheels positioned upstream of the feed assembly and at least some of said wheels positioned downstream of the feed assembly, the length of recording carrier between the upstream positioned wheels and the downstream positioned wheels being such that the belt pins downstream of the feed assembly engages different recording carrier holes from those engaged upstream of the feed assembly.

5. A device according to claim 1 wherein the belt assemblies are attached to separate housing members, at least one of the housing members being movable towards and away from the other housing member whereby the space between the belt assemblies can be adjusted to compensate for different width recording carriers.

6. A combined transport and feed unit for moving a side margin punched recording carrier past an intermediate carrier in a nonmechanical printing device comprising: parallel spaced apart housing members supporting at least three axially aligned rotatable wheel pairs, a belt trained around the wheels of each of the housing members, the belt having a plurality of spaced apart projecting recording carrier hole engaging pins thereon, at least one pair of wheels interconnected by a driven shaft, the housing members being pivotable about the driven shaft, a feed assembly carried by said housing members, the belts effective to engage a recording carrier at an upstream end of the unit and to transport the recording carrier by engagement of the pins with the recording carrier holes to an upstream end of the feed assembly, to thereafter disengage from the recording carrier and to re-engage the recording carrier at a downstream end of the feed assembly and to transport the recording carrier to a downstream end of the unit, each of the wheel pairs having axes, the axes of the at least three axially aligned rotatable wheel pairs being spaced from one another such that they form apexes of a triangle.

7. A device according to claim 6 wherein at least one of the housing members is movable towards and away from the other housing member whereby the distance between the belts can be adjusted.

8. The device of claim 7 wherein the belt pins are spaced from one another such that they engage only in every second hole of the recording carrier, the length of the recording carrier from the point of disengagement to the point of engagement being such that the pins engage alternate holes on the upstream and the downstream sides of the feed assembly.

* * * * *